US006220671B1

(12) United States Patent
Montgomery, Jr.

(10) Patent No.: US 6,220,671 B1
(45) Date of Patent: Apr. 24, 2001

(54) CUTTING TOOL HOLDER RETENTION SYSTEM

(75) Inventor: Robert H. Montgomery, Jr., Everett, PA (US)

(73) Assignee: Kennametal PC Inc., Monovia, CA (US)

( * ) Notice: Subject to any disclaimer, the term of this patent is extended or adjusted under 35 U.S.C. 154(b) by 0 days.

(21) Appl. No.: 09/350,783

(22) Filed: Jul. 9, 1999

(51) Int. Cl.[7] ..... E21C 35/193
(52) U.S. Cl. ..... 299/102; 299/103
(58) Field of Search ..... 299/102, 103

(56) References Cited

U.S. PATENT DOCUMENTS

| | | | |
|---|---|---|---|
| 3,749,449 | 7/1973 | Krekeler | 299/93 |
| 4,057,294 | 11/1977 | Krekeler . | |
| 4,302,055 | 11/1981 | Persson . | |
| 4,609,227 | 9/1986 | Wild et al. . | |
| 4,650,254 | 3/1987 | Wechner | 299/91 |
| 4,744,605 | 5/1988 | Komotzki . | |
| 4,762,372 | 8/1988 | Rassmann et al. . | |
| 5,029,944 | 7/1991 | Komotzki . | |
| 5,322,351 | 6/1994 | Lent | 299/87 |
| 5,378,050 | 1/1995 | Kammerer et al. . | |
| 5,573,308 * | 11/1996 | Simons et al. | 299/102 |
| 5,605,382 | 2/1997 | Massa | 299/107 |
| 5,683,144 | 11/1997 | Kammerer et al. . | |
| 5,769,505 | 6/1998 | Siddle et al. | 299/102 |
| 5,833,323 | 11/1998 | Massa et al. . | |

FOREIGN PATENT DOCUMENTS

| | | |
|---|---|---|
| 657 194 | 6/1965 | (BE) . |
| 1 224 502 | 7/1987 | (CA) . |
| 23 19 619 | 12/1974 | (DE) . |
| 32 43 583 A1 | 5/1984 | (DE) . |
| 3317146 | 11/1984 | (DE) . |
| 34 34 348 A1 | 2/1986 | (DE) . |
| 40 15 022 A1 | 11/1990 | (DE) . |
| 9411545 | 9/1994 | (DE) . |
| 29822369 | 3/1999 | (DE) . |
| 29901986 | 4/1999 | (DE) . |

* cited by examiner

*Primary Examiner*—William Neuder
(74) *Attorney, Agent, or Firm*—Kevin P. Weldon

(57) ABSTRACT

This invention relates to an excavation cutting tool holder retention system. The excavation cutting tool holder retention system includes a support block having a tool holder bore. The excavation cutting tool holder retention system also includes a tool holder having an effective shank, the effective shank being expandably adjustable within the tool holder bore so as to retain the effective shank within the tool holder bore.

36 Claims, 2 Drawing Sheets

CUTTING TOOL HOLDER RETENTION SYSTEM

TECHNICAL FIELD

This invention relates to excavation cutting tools, and more particularly a cutting tool holder retention system for retaining a cutting tool holder within a support block during use.

BACKGROUND ART

Excavation cutting tool assemblies for such applications as continuous mining or road milling typically comprise a cutting tool, sometimes referred to as a cutting bit, rotatably mounted within a cutting tool holder, sometimes referred to as a cutting tool sleeve, bit holder, or bit sleeve. In such assemblies, the cutting tool holder is mounted within a support block. The support block in turn is mounted onto a drum or other body, typically by welding, which in turn is driven by a suitable power means. When a number of such support blocks carrying cutting tool holders and cutting tools are mounted onto a drum or other body, and the drum or other body is driven, the cutting tools will engage and break up the material which is sought to be mined or removed. The general operation of such mining, road milling, or other such machines is well known in the art.

As mentioned, the cutting tool holder may be mounted within the support block, typically via some mechanical connection. For example, U.S. Pat. No. 5,322,351 to Lent (referred to as the Lent patent) discloses a cutting tool holder 42 mounted within a tool holder receiving pocket 28 of a support block, referred to in the Lent patent as a segment member 18, via a wedge member 46. The wedge member 46 is movably connected to the support block via an adjustable screw member 54. To use the apparatus disclosed in the Lent patent, a cutting tool holder 42 is disposed in the tool holder receiving pocket 28 such that the base portion of the tool holder mates with, and is located under, an inclined wall surface 24 within the receiving pocket 28. The wedge member 46 is then moved by tightening the adjustable screw member 54 such that the cutting tool holder 42 is held in place by the wedge member 46 and the inclined wall surface 24 of the receiving pocket 28 within the receiving pocket 28 of the support block.

As another example, U.S. Pat. No. 5,378,050 to Kammerer and Diessner (referred to as the Kammerer patent) discloses a chisel holder 30 having a neck 31 which may be inserted into a plug-in receptacle 21 of a support block, referred to as a basic part 20 in the Kammerer patent. The plug-in neck 31 has a recess 37 which defines a pressure surface 38. The pressure surface 38 faces a pressure screw 50 adjustably disposed in the support block, the basic part 20, so as to intersect the plug-in receptacle 21. The pressure screw 50 may be adjusted such that the pressure screw 50 protrudes into the recess 37 of the neck 31 of the chisel holder 30 and such that a retracting force is exerted on the pressure surface 38 of the chisel holder 30.

As yet another example, U.S. Pat. No. 4,057,294 to Kreckler (referred to as the Kreckler patent) discloses a removable member 52, into which the shank of a cutter bit 52*c* may be mounted, mounted within a dove-tailed slot 51 of a base member 50 via a wedge element 53. The wedge element 53 is movably connected to the removable member 52 via a bolt 54. To use the apparatus disclosed in FIGS. 1–3 of the Kreckler patent, the removable member 52 is disposed in the dove-tailed slot 51 such that an inclined portion 52*a* of the removable member 52 is in contact with, and located under, an inclined portion 50*a* of the base member 50. The wedge element 53 is then moved by tightening the bolt 54 such that the removable member 52 is held in place by the wedge element 53 and the inclined portion 50*a* within the dove-tailed slot 51 of the base member 50.

SUMMARY OF THE INVENTION

An object of the invention is to provide an improved cutting tool holder retention system which allows a cutting tool holder to be assembled with a support block.

In carrying out the above object, and other objects and features of the present invention, an improved cutting tool holder retention system is provided. The improved cutting tool holder retention system comprises a support block and a tool holder. The support block has a tool holder bore and the tool holder has an effective shank, the effective shank being expandably adjustable within the tool holder bore so as to retain the effective shank within the tool holder bore. The effective shank may be retained within the tool holder bore by way of frictional engagement.

In a more specific embodiment, the effective shank is defined by a holder shank and a retainer portion, the retainer portion being adjustably connected to the holder shank such that the effective shank is expandable within the tool holder bore so as to retain the effective shank within the tool holder bore. In such case, the effective shank may be retained within the tool holder bore by way of frictional engagement.

In a preferred embodiment, the holder shank has a shank wedge surface and the retainer portion has a retainer wedge surface, the retainer portion being adjustably connected to the holder shank such that the retainer wedge surface engages the shank wedge surface so as to expand the effective shank. In such case, the tool holder bore may have a bore interior surface and the retainer portion may have a retainer engagement surface, the retainer engagement surface and holder shank defining an effective shank dimension which is expandable within the tool holder bore so as to retain the effective shank within the tool holder bore. Additionally, in such case the tool holder may have a holder bore, the holder bore intersecting at least a portion of the holder shank, and the retainer portion may have a retainer pin bore, at least one of the holder bore and retainer pin bore being threaded. Such embodiment would further include a pin having a pin threaded portion. The pin would run through the holder bore and retainer pin bore and the pin threaded portion would threadably engage the at least one of the holder bore and retainer pin bore so as to adjustably connect the retainer portion and holder shank such that by rotation of the pin the retainer portion is movable relative to the holder shank.

In an alternative embodiment, the excavation cutting tool holder retention system includes a support block, a tool holder, and a retainer. The support block has a tool holder bore. The tool holder has a holder shank, the holder shank having a shank axis and a shank wedge surface, the shank wedge surface being inclined relative to the shank axis. The retainer has a retainer wedge surface and a retainer engagement surface. The retainer is adjustably connected to the tool holder such that the retainer wedge surface slidingly engages the shank wedge surface and such that the retainer engagement surface and the holder shank cooperate to retain the holder shank within the tool holder bore. The retainer engagement surface and the holder shank may cooperate to retain the holder shank within the tool holder bore by way of frictional engagement with the tool holder bore.

In a preferred embodiment, the retainer is adjustably connected to the tool holder by way of a pin. In such case, the tool holder may have a tool holder bore, the holder bore intersecting at least a portion of the holder shank, and the retainer may have a retainer pin bore, at least one of the holder bore and the retainer pin bore being threaded. The pin may have a pin threaded portion which threadably engages the at least one of the holder bore and retainer pin bore such that by rotation of the pin the retainer is movable relative to the holder shank as the retainer wedge surface slidingly engages the shank wedge surface.

In yet another preferred embodiment, the pin has a pin diameter and the holder bore has a holder bore diameter, the holder bore diameter being greater than the pin diameter such that the pin may move laterally within the holder bore to allow the retainer to move relative to the holder shank.

In yet another preferred embodiment, the shank wedge surface may have a first shank wedge surface portion located on one side of the holder bore and a second shank wedge surface located on the other side of the holder bore. In such case, the retainer wedge surface may have a first retainer wedge surface portion located on one side of the retainer pin bore and a second retainer wedge surface portion located on the other side of the retainer pin bore such that the first and second retainer wedge surface portions slidingly engage the first and second shank wedge surface portions respectively and such that the retainer engagement surface and the holder shank cooperate to retain the holder shank within the tool holder bore.

In yet another preferred embodiment, the other one of the holder pin bore and retainer pin bore may have a pin bore shoulder, and the pin may have a pin head which engages the pin bore shoulder.

In another alternative embodiment, the excavation cutting tool holder retention system includes a support block, a tool holder, a retainer, and a pin. The support block has a tool holder bore. The tool holder has a holder shank and a holder bore, the holder bore intersecting at least a portion of the holder shank. The pin runs through the holder bore and adjustably connects the retainer to the holder shank such that the retainer is movable relative to the holder shank and such that the holder shank and retainer cooperate to retain the holder shank within the tool holder bore. In such case, the holder shank and retainer may cooperate to retain the holder shank within the tool holder bore by way of frictional engagement with the tool holder bore.

In a preferred embodiment, the holder shank has a shank wedge surface and the retainer has a retainer wedge surface which slidingly engages the shank wedge surface such that the retainer is movable relative to the holder shank. In such case, it is preferred that the holder shank have a shank axis and that the shank wedge surface be inclined relative to the shank axis.

In an alternative embodiment, the shank wedge surface is a first shank wedge surface portion on one side of the holder bore and a second shank wedge surface portion on the other side of the holder bore.

In another preferred embodiment, the retainer has a threaded retainer pin bore and the pin has a pin head which engages the holder bore and a pin threaded portion which threadably engages the retainer pin bore. Accordingly, the pin head may be rotated to draw the holder shank and retainer toward each other and such that the retainer wedge surface slidingly engages the shank wedge surface so as to move the retainer relative to the holder shank.

In another preferred embodiment, the shank wedge surface may have a first shank wedge surface portion on one side of the holder bore and a second shank wedge surface portion on the other side of the holder bore. The retainer pin bore may likewise have a first retainer wedge surface portion located on one side of the retainer pin bore and a second retainer wedge surface portion located on the other side of the retainer pin bore such that the first and second retainer wedge surface portions slidingly engage the first and second shank wedge surface portions respectively and such that the retainer and holder shank cooperate to retain the holder shank within the tool holder bore.

In a preferred embodiment, the pin has a pin diameter and the holder pin bore has a holder pin bore diameter greater than the pin diameter to facilitate lateral movement of the retainer relative to the holder shank.

In yet another alternative embodiment, the excavation cutting tool holder retention system includes a support block, a tool holder, and a retainer. The support block has a tool holder bore, the tool holder bore having a bore interior surface. The tool holder has a holder shank. The retainer has a retainer compressible surface, the retainer being adjustably connected to the tool holder such that the retainer compressible surface is compressed against the bore interior surface so as to retain the holder shank within the tool holder bore.

In a preferred embodiment, the tool holder bore has a bore recess and at least a portion of the compressible surface of the retainer protrudes into the bore recess when the retainer compressible surface is compressed.

In another preferred embodiment, the holder shank and the retainer compressible surface define a shank effective dimension which is adjustably expandable within the tool holder bore and such that the retainer compressible surface is compressed against bore interior surface so as to retain the holder shank within the tool holder bore. In such case, it is preferable that the tool holder bore has a bore recess and at least a portion of the compressible surface of the retainer protrudes into the bore recess when the retainer compressible surface is compressed.

In fact, in all of these embodiments, at least a portion of the retainer of the retainer engagement surface may be a retainer compressible surface such that the retainer compressible surface is compressed against the bore interior surface so as to retain the effective shank or holder shank within the tool holder bore. In such case, it is preferable that the tool holder bore has a bore recess and the at least a portion of the compressible surface of the retainer engagement surface protrudes into the bore recess when the retainer compressible surface is compressed.

The present invention also includes an improved retainer portion of an effective shank for use with a support block, a tool holder, and a pin, the support block having a tool holder bore, the tool holder bore having a bore interior surface, the tool holder having a holder shank, the holder shank having a shank axis and a shank wedge surface, the shank wedge surface being inclined relative to the shank axis, the tool holder also having a holder bore intersecting at least a portion of the holder shank, the pin having a pin head which engages the tool holder and a pin threaded end. The improved retainer portion of the effective shank comprises a retainer having a retainer wedge surface, a retainer engagement surface, and a threaded retainer pin bore. The threaded retainer pin bore threadably engages the pin threaded end such that rotation of the pin will cause the retainer wedge surface to slidably engage the shank wedge surface and such that the retainer engagement surface and the holder shank cooperate to retain the holder shank within the tool holder bore.

In a preferred embodiment, the retainer wedge surface has a first retainer wedge surface portion located on one side of the retainer pin bore and a second retainer wedge surface portion located on the other side of the retainer pin bore.

The present invention also includes an improved tool holder for use with a support block, a retainer, and a pin, the support block having a tool holder bore, the tool holder bore having a bore interior surface, the retainer having a retainer wedge surface and a retainer engagement surface, the pin having a pin head and a pin diameter. The improved tool holder comprises an outer wear region and a holder shank. The holder shank has a shank axis and a shank wedge surface. The shank wedge surface is inclined relative to the shank axis. The tool holder also has a holder pin bore intersecting at least a portion of the holder shank and receiving the pin which is adjustably connected to the retainer such that the retainer wedge surface slidingly engages the shank wedge surface and such that the retainer engagement surface and the holder shank cooperate to retain the holder shank within the tool holder bore.

In a preferred embodiment, the shank wedge surface has a first shank wedge surface portion located on one side of the holder pin bore and second shank wedge surface portion located on the other side of the holder pin bore.

In another preferred embodiment, the holder pin bore has a holder pin bore diameter greater than the pin diameter to facilitate lateral movement of the retainer relative to the holder shank.

The advantages resulting from this invention are numerous. For example, the components are relative simple to manufacture and use.

Another advantage is the relative simplicity of relying on an expandable effective shank to retain the holder shank within the tool holder bore of the support block.

Yet another advantage is that relatively large retention forces may be generated by the sliding engagement between the retainer wedge surface and the shank wedge surface.

In embodiments where the retainer has a retainer compressible surface, another advantage is that the retainer compressible surface is compressed against the bore interior surface so as to accentuate retention. This effect is increased in embodiments where the tool holder bore includes a bore recess such that the retainer compressible surface is compressed so as to protrude into the bore recess.

In embodiments where the retainer wedge surface consists of a first retainer wedge surface portion and a second retainer wedge surface portion bisected by the retainer pin bore, the resulting double seat arrangement also provides the advantage of minimizing bending forces on the pin.

Further objects and advantages of this invention will be apparent from the following description, reference being had to the accompanying drawings in which one embodiment of the present invention is shown.

BRIEF DESCRIPTION OF DRAWINGS

While an embodiment of the invention is illustrated, the particular embodiment shown should not be construed to limit the claims. It is anticipated that various changes and modifications may be made, and that various embodiments may be employed, without departing from the scope of this patent.

BEST MODE FOR CARRYING OUT THE INVENTION

Figure 1:
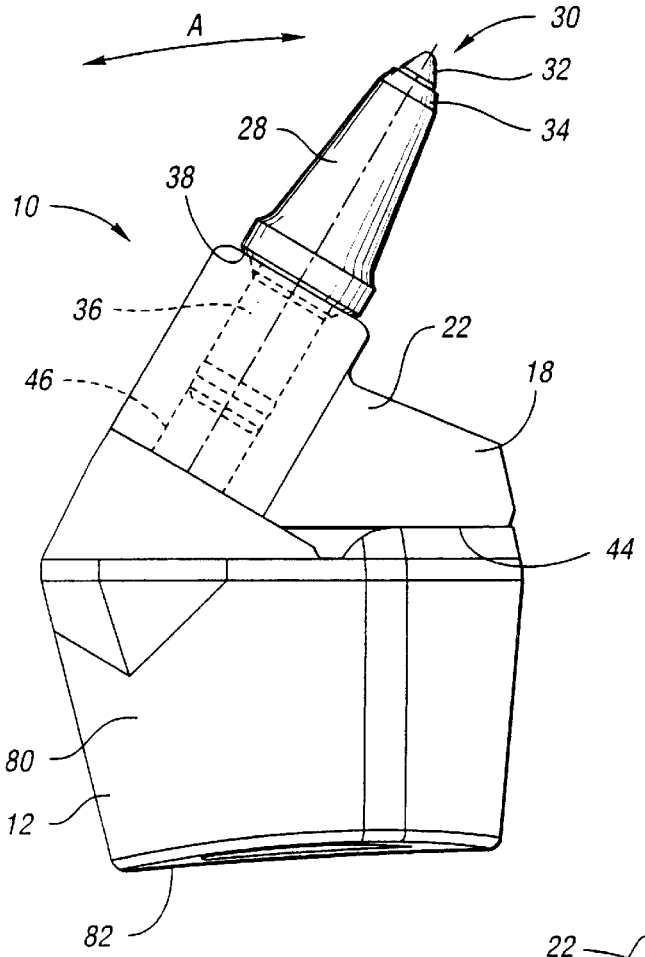
FIG. 1 is a side view of a cutting tool holder assembled with a support block showing one embodiment of the invention.
Figure 2:
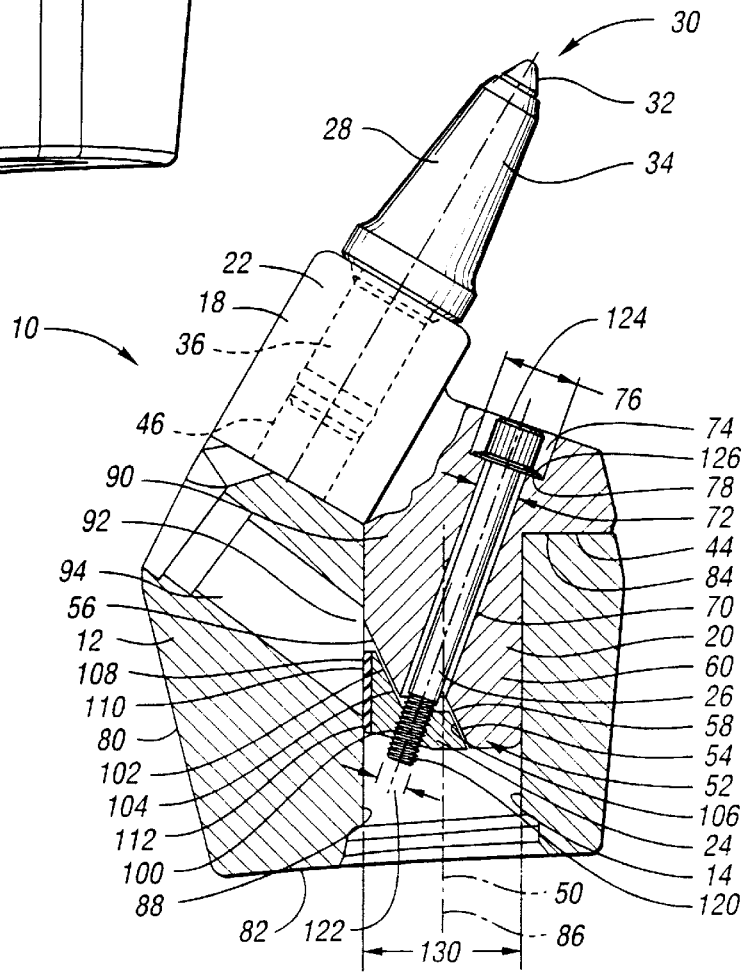
FIG. 2 is a side view identical to FIG. 1, except that the support block and the cutting tool holder shank are shown in cross-section, showing the components in a loosened condition.
Figure 3:
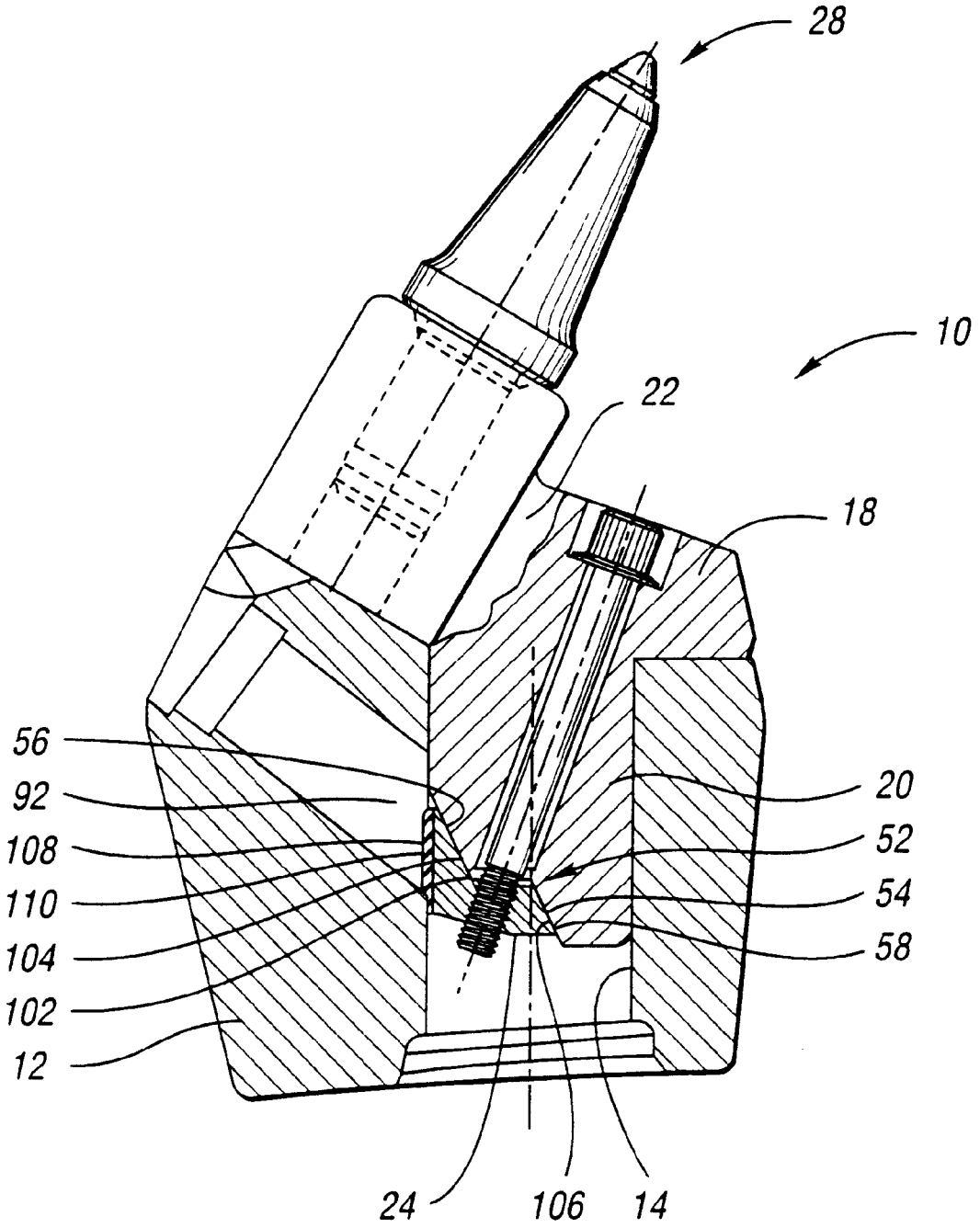
FIG. 3 is a side view identical to FIG. 2 except that the components are in a tightened condition.

One embodiment of the cutting tool holder retention system 10 is shown in FIGS. 1–3. The cutting tool holder retention system 10 includes a support block 12 having a tool holder bore 14. The cutting tool holder retention system 10 also includes a cutting tool holder 18 having a holder shank 20 joined to an outer wear portion 22. The cutting tool holder retention system 10 further includes a retainer 24. In the embodiment shown, a pin 26 is used to adjustably connect the retainer 24 to the holder shank 20 of the cutting tool holder 18. As indicated in the embodiment shown, a cutting tool 28 may be rotatably and releasably mounted within the cutting tool holder 18. However, the scope of this patent covers cutting tool holder retention systems in which the cutting tool is mounted to the cutting tool holder in any manner, non-rotatably or otherwise.

In use, such support blocks 12 can be distributed over and fastened to, such as by welding or any other suitable method, the circumference and length of a drum or other body (not shown) according to any desired pattern. The drum or other body may be driven by any conventional or suitable power means to cause the cutting tools 28 to engage and break up material that they are applied to. Such applications are well known in the art, and will not be described in further detail here.

The cutting tool 28 typically has an elongated body. A cutting end 30 typically comprises a hard cutting insert 32 mounted onto a generally conical outer region 34. The hard cutting insert 32 may be made from cemented tungsten carbide or any other suitable material. The hard cutting insert 32 is generally mounted at the end of the conical outer region 34 where the hard cutting insert 32 may be brazed or otherwise suitably fastened into place. The cutting tool 28 also typically includes a cutting tool shank 36 adjoining a cutting tool shoulder 38 of the conical outer region 34. Because such cutting tools are generally known in the art, they will not be described in further detail here.

The cutting tool holder 18 may have a variety of configurations. The cutting tool holder 18 shown in this embodiment has the outer wear portion 22 and the holder shank 20 joined at a holder shoulder 44. The cutting tool holder 18 shown in this embodiment also defines a tool bore 46 in which the cutting tool 28 may be rotatably or otherwise mounted. Such rotatable or non-rotatable mountings are well known in the art, and will not be described in further detail here.

The holder shank 20 of the cutting tool holder 18 may itself also have a variety of configurations. In this embodiment, as shown in FIG. 2, the holder shank 20 has a shank axis 50 and a shank end 52. The shank end 52 defines a shank wedge surface 54 which is inclined relative to the remainder of the holder shank 20 or the shank axis 50. An angle of such inclination in the range of 12°–15° is believed suitable. In this particular embodiment, the shank wedge surface 54 has a first shank wedge surface portion 56 and a second shank wedge surface portion 58.

In this embodiment, as shown in FIG. 2, the tool holder 18 also defines a holder pin bore 70 having a holder pin bore diameter 72. In fact, in this embodiment, the holder pin bore 70 intersects at least a portion of the holder shank 20. Furthermore, in this embodiment, as shown in FIG. 2, the holder pin bore 70 intersects the shank end 52 between the first shank wedge surface portion 56 and the second shank wedge surface portion 58.

In this embodiment, as shown in FIG. 2, a pin bore recess 74 is located adjacent the pin bore 70 at the outer surface of the tool holder 18. That pin bore recess 74 has a pin bore recess diameter 76. In this embodiment, the pin bore recess 74 defines a pin bore shoulder 78 at the intersection of the pin bore recess 74 and the holder pin bore 70.

Like cutting tool holders, the support block 12 may have a variety of configurations. As shown in FIGS. 1–2, in this embodiment the support block 12 has a block side surface 80 and a block base 82 which may be mounted to a drum or other body (not shown) by welding or any other suitable method.

The tool holder bore 14 of such a support block 12 is typically surrounded by a seating shoulder region 84. The tool holder bore 14 of such a support block 12 has a bore axis 86 which is coincidental with the shank axis 50 when the components are assembled as shown in FIG. 2. The tool holder bore 14 defines a bore interior surface 88 and has a bore opening 90 intersecting the seating shoulder region 84. In this embodiment, the tool holder bore 14 also has a bore recess 92. In this embodiment, as shown in FIG. 2, the bore recess 92 is defined by a secondary bore 94 which intersects the tool holder bore 14.

The tool holder bore 14 of the support block 12, and the tool bore 46 of the tool holder 18, and accordingly the cutting tool 28, are typically pitched in the direction of travel of the cutting tool 28, designated as direction "A" on FIG. 1.

Like the cutting tool holder 18 and support block 12, the retainer 24 may have a variety of configurations. The retainer 24 together with the holder shank 20 are an effective shank 60. Accordingly, the retainer 24 is also referred to as the retainer portion of the effective shank 60.

As shown in FIG. 2, the retainer 24 of this embodiment has a retainer pin bore 100. In this particular embodiment, the retainer pin bore 100 is threaded.

The retainer 24 also has a retainer wedge surface 102, which, in this embodiment as shown in FIG. 2, slidingly engages the shank wedge surface 54. In this particular embodiment, the retainer wedge surface 102 has a first retainer wedge surface portion 104 and a second retainer wedge surface portion 106 which slidingly engage the first shank wedge surface portion 56 and the second shank wedge surface portion 58 of the shank wedge surface 54 respectively when the components are assembled. As shown in FIG. 2, the first retainer wedge surface portion 104 and the second retainer wedge surface portion 106 are preferably located, as will be explained, on opposite sides of the retainer pin bore 100.

In this embodiment, as shown in FIG. 2, the retainer 24 also has a retainer engagement surface 108 which engages the bore interior surface 88 of the tool holder bore 18 of the support block 12 when the components are assembled. While not required, in a preferred embodiment at least a portion of the retainer engagement surface 108 is a retainer compressible surface 110. In this embodiment, the retainer compressible surface 110 may consist of an outer surface of compressible material 112 fastened to the retainer 24. Any suitable material could be used as a compressible material 112 to define the retainer compressible surface 110, such as any suitable rubber. Because such compressible material 112, such as rubber, may have a higher coefficient of friction than a metallic surface, the holder shank 20 is more effectively retained within the tool holder bore 14 when the components are assembled as will be explained. Such compressible material 112 may have a male protrusion (not shown) which mates with a retainer recess (not shown) defined by the retainer 24 so as to connect the compressible material 112 to the retainer 24. While not shown, such a male protrusion of the compressible material 112 may have an enlarged portion which could be compressed and forced into the retainer recess of the retainer 24 such that the enlarged portion would then expand within the retainer recess of the retainer 24 with the result of locking the compressible material 112 to the retainer 24. Such compressible material 112 may also be fastened to the retainer 24 by using any suitable adhesive such as a weather strip adhesive. One such weather strip adhesive is sold by Minnesota Mining and Manufacturing Company.

As shown in FIG. 2, the cutting tool holder retention system 10 of this embodiment also includes the pin 26 having a pin threaded portion 120 which threadably engages the threaded retainer pin bore 100 of the retainer 24. The pin 26 also has a pin diameter 122. In this embodiment, the pin 26 also has a pin head 124 which engages the pin bore shoulder 78 such that the pin 26 may be rotated so as to draw the retainer 24 toward the shank end 52 when the components are assembled as shown and used as will be explained. It is preferable that the pin head 124 be located in a recess, such as the pin bore recess 74 shown, to nimize damage to the pin during use. It has been found suitable to use a ⅜ Grade 8 socket head cap screw as the pin 26 together with a spherical seat with Bellville washers (shown at 126). Of course, any suitable pin, and any suitable arrangement, could be utilized.

When the retainer 24, also referred to as the retainer portion of the effective shank 60, is assembled with the holder shank 20 and the pin 26 as shown in FIG. 2, the retainer 24 and holder shank 20 together define an effective shank dimension 130 which is adjustable as will be explained. In the embodiment shown, the effective shank dimension 130 is the distance between the retainer engagement surface 108 and that side of the holder shank 20 opposite the retainer engagement surface 108.

To use the embodiment of this invention shown in FIGS. 1–3, the pin 26 is inserted into the holder pin bore 70 of the tool holder 18. The retainer 24, also referred to as the retainer portion of the effective shank 60, is then loosely threaded onto the pin threaded portion 120 of the pin 26. The holder shank 20 of the tool holder 18, including the retainer 24, may then be inserted into the tool holder bore 14 of the support block 12 with or without the cutting tool 28, as shown in FIG. 2.

The pin head 124 may then be rotated so that the retainer 24 will be drawn toward the shank end 52 of the holder shank 20 via the threaded engagement between the pin threaded portion 120 of the pin 26 and the threaded retainer pin bore 100 of the retainer 24.

As shown in FIG. 3, when the retainer 24 is drawn toward the shank end 52 of the holder shank 20, the retainer wedge surface 102 will slidingly engage the shank wedge surface 54 such that the retainer 24 will move laterally with respect to the shank axis 50 thus increasing the effective shank dimension 130. More specifically, in the particular embodiment shown in FIGS. 1–3, the first retainer wedge surface portion 104 and the second retainer wedge surface portion 106 will slidingly engage the first shank wedge surface portion 56 and the second shank wedge surface portion 58 respectively so as to expand the effective shank dimension 130.

More specifically, as the effective shank dimension 130 expands the retainer engagement surface 108 and that portion of the holder shank 20 opposite the retainer engagement surface 108 will be forced against the bore interior surface 88 of the tool holder bore 14. As a result, the retainer engagement surface 108 and the holder shank 20 cooperate to retain the holder shank 20 within the tool holder bore 14 of the support block 12 during use.

In this particular embodiment, the retainer engagement surface 108 and the holder shank 20 cooperate to retain the holder shank 20 within the tool holder bore 14 of the support block 12 by way of frictional engagement with the bore interior surface 88 of the tool holder bore 14. However, while not shown, it is anticipated that such retention could result solely from or be augmented by such a system where a protrusion from the side of the retainer 24 or holder shank 20, would be caused to protrude into a recess in the bore interior surface 88.

As shown in FIG. 3, when the retainer 24 is forced laterally relative to the shank axis 50 in this particular embodiment, the retainer compressible surface 110 is compressed against the bore interior surface 88. This further serves to increase the frictional engagement between the retainer engagement surface 108 of the retainer 24 and the tool holder bore 14 of the support block 12. Furthermore, as shown in FIG. 3, when the tool holder bore 14 of the support block 12 includes a bore recess 92, and the components are assembled as shown, the retainer compressible surface 110 is forced to protrude into the bore recess 92, further locking the components together.

When it is desired to change the cutting tool holder 18, the pin head 124 is rotated in the opposite direction such that the retainer 24 is forced away from the shank end 52 of the holder shank 20. When the components are sufficiently loosened, the holder shank 20 of the tool holder 18 may be simply removed from the tool holder bore 14 of the support block 12.

One advantage of the cutting tool holder retention system is that the components are relatively simple to manufacture and to use.

Another advantage of this cutting tool holder retention system is the relative simplicity of relying on an expandable effective shank to retain the holder shank 20 within the tool holder bore 14 of the support block 12.

Yet another advantage of this cutting tool holder retention system is that relatively large retention forces may be generated by the sliding engagement between the retainer wedge surface 102 and the shank wedge surface 54.

In embodiments where the retainer 24 has a retainer compressible surface 110, another advantage is that the retainer compressible surface 110 is compressed against the bore interior surface 88 so as to accentuate retention when the retainer 24 is drawn toward the shank end 52 of the holder shank 20 when the pin 26 is rotated. This effect is increased in embodiments where the tool holder bore 14 includes the bore recess 92 such that when the retainer 24 is drawn toward the shank end 52 of the holder shank 20, the retainer compressible surface 110 is compressed so as to protrude into the bore recess 92 of the tool holder bore 14 and further retain the components together.

In embodiments where the retainer wedge surface 102 consists of a first retainer wedge surface portion 104 and a second retainer wedge surface portion 106 bisected by the retainer pin bore 100, the resulting double seat arrangement also provides the advantage of minimizing bending forces on the pin 26.

While particular embodiments of the invention have been illustrated and described, it will be obvious to those skilled in the art that various changes and modifications may be made, and other embodiments utilized, without departing from the scope of this patent. It is intended that the following claims cover all such modifications and embodiments, and all other modifications and embodiments, and all equivalents of such modifications and embodiments, that fall within the spirit of this invention.

What is claimed is:

1. An excavation cutting tool holder retention system comprising a support block having a tool holder bore; and a tool holder having an effective shank, the effective shank being expandably adjustable within the tool holder bore so as to retain the effective shank within the tool holder bore.

2. The excavation cutting tool holder retention system of claim 1 wherein the effective shank is retained within the tool holder bore by way of frictional engagement.

3. The excavation cutting tool holder retention system of claim 1 wherein the effective shank is defined by a holder shank and a retainer portion, the retainer portion being adjustably connected to the holder shank such that the effective shank is expandable within the tool holder bore so as to retain the effective shank within the tool holder bore.

4. The excavation cutting tool holder retention system of claim 3 wherein the effective shank is retained within the tool holder bore by way of frictional engagement.

5. The excavation cutting tool holder retention system of claim 3 wherein the retainer portion is adjustably connected to the holder shank via a pin which threadably engages at least one of the retainer portion and holder shank.

6. An excavation cutting tool holder retention system comprising a support block having a tool holder bore;

a tool holder having a holder shank, the holder shank having a shank axis and a shank wedge surface, the shank wedge surface being inclined relative to the shank axis; and a retainer having a retainer wedge surface and a retainer engagement surface, the retainer being adjustably connected to the tool holder such that the retainer wedge surface slidingly engages the shank wedge surface and such that the retainer engagement surface and the holder shank cooperate to retain the holder shank within the tool holder bore.

7. The excavation cutting tool holder retention system of claim 6 wherein the retainer engagement surface and the holder shank cooperate to retain the holder shank within the tool holder bore by way of frictional engagement with the tool holder bore.

8. The excavation cutting tool holder retention system of claim 6 wherein the retainer is adjustably connected to the tool holder by way of a pin.

9. The excavation cutting tool holder retention system of claim 8 wherein the tool holder has a holder bore, the holder bore intersecting at least a portion of the holder shank, and the retainer has a retainer pin bore, at least one of the holder bore and the retainer pin bore being threaded, the pin having a pin threaded portion which threadably engages the at least one of the holder bore and retainer pin bore such that by rotation of the pin the retainer is movable relative to the holder shank as the retainer wedge surface slidingly engages the shank wedge surface.

10. The excavation cutting tool holder retention system of claim 9 wherein the pin has a pin diameter and the holder bore has a holder bore diameter, the holder bore diameter being greater than the pin diameter such that the pin may move laterally within the holder bore to allow the retainer to move relative to the holder shank.

11. The excavation cutting tool holder retention system of claim 9 wherein the shank wedge surface has a first shank wedge surface portion located on one side of the holder bore and a second shank wedge surface portion located on the other side of the holder bore, and the retainer wedge surface has a first retainer wedge surface portion located on one side of the retainer pin bore and a second retainer wedge surface located on the other side of the retainer pin bore such that the first and second retainer wedge surface portions slidingly engage the first and second shank wedge surface portions respectively and such that the retainer engagement surface and the holder shank cooperate to retain the holder shank within the tool holder bore.

12. The excavation cutting tool holder retention system of claim 9 wherein the other one of the holder pin bore and retainer pin bore has a pin bore shoulder, and the pin has a pin head which engages the pin bore shoulder.

13. The excavation cutting tool holder retention system of claim 6 wherein the tool holder bore has a bore interior surface and at least a portion of the retainer engagement surface is a retainer compressible surface such that the retainer compressible surface is compressed against the bore interior surface when the retainer engagement surface and holder shank cooperate to retain the holder shank within the tool holder bore.

14. The excavation cutting tool holder retention system of claim 13 wherein the tool holder bore has a bore recess and at least a portion of the compressible surface of the retainer protrudes into the bore recess when the retainer compressible surface is compressed.

15. An excavation cutting tool holder retention system comprising a support block having a tool holder bore;

a tool holder having a holder shank and a holder bore, the holder bore intersecting at least a portion of the holder shank;

a retainer;

a pin running through the holder bore and adjustably connecting the retainer to the holder shank such that the retainer is movable relative to the holder shank and such that the holder shank and retainer cooperate to retain the holder shank within the tool holder bore.

16. The excavation cutting tool holder retention system of claim 15 wherein the holder shank and retainer cooperate to retain the holder shank within the tool holder bore by way of frictional engagement with the tool holder bore.

17. An excavation cutting tool holder retention system comprising a support block having a tool holder bore, the tool holder bore having a bore interior surface;

a tool holder having a holder shank; and a retainer having a retainer compressible surface, the retainer being adjustably connected to the tool holder such that the retainer compressible surface is compressed against the bore interior surface so as to retain the holder shank within the tool holder bore.

18. A retainer portion of an effective shank for use with a support block, a tool holder, and a pin, the support block having a tool holder bore, the tool holder bore having a bore interior surface, the tool holder having a holder shank, the holder shank having a shank axis and a shank wedge surface, the shank wedge surface being inclined relative to the shank axis, the tool holder also having a holder bore intersecting at least a portion of the holder shank, the pin having a pin head which engages the tool holder and a pin threaded end, the retainer portion of the effective shank comprising a retainer having a retainer wedge surface, a retainer engagement surface, and a threaded retainer pin bore, the threaded retainer pin bore threadably engaging the pin threaded end such that rotation of the pin will cause the retainer wedge surface to slidably engage the shank wedge surface and such that the retainer engagement surface and the holder shank cooperate to retain the holder shank within the tool holder bore.

19. The retainer of claim 18 wherein the retainer wedge surface has a first retainer wedge surface portion located on one side of the retainer pin bore and a second retainer wedge surface portion located on the other side of the retainer pin bore.

20. A tool holder for use with a support block, a retainer, and a pin, the support block having a tool holder bore, the tool holder bore having a bore interior surface, the retainer having a retainer wedge surface and a retainer engagement surface, the pin having a pin head and a pin diameter, the tool holder comprising an outer wear region and a holder shank, the holder shank having a shank axis and a shank wedge surface, the shank wedge surface being inclined relative to the shank axis, the tool holder also having a holder pin bore intersecting at least a portion of the holder shank and receiving the pin which is adjustably connected to the retainer such that the retainer wedge surface slidingly engages the shank wedge surface and such that the retainer engagement surface and the holder shank cooperate to retain the holder shank within the tool holder bore.

21. The tool holder of claim 20 wherein the shank wedge surface has a first shank wedge surface portion located on one side of the holder pin bore and a second shank wedge surface portion located on the other side of the holder pin bore.

22. The tool holder of claim 20 wherein the holder pin bore has a holder pin bore diameter greater than the pin diameter to facilitate lateral movement of the retainer relative to the holder shank.

23. An excavation cutting tool holder retention system comprising:

a support block having a tool holder bore, and a tool holder having an effective shank, the effective shank becoming expandably adjustable within the tool holder bore so as to retain the effective shank within the tool holder bore:

wherein the effective shank is defined by a holder shank and a retainer portion, the retainer portion being adjustably connected to the holder shank such that the effective shank is expandable within the tool holder bore so as to retain the effective shank within the tool holder bore;

wherein said holder shank has a shank wedge surface and the retainer portion has a retainer wedge surface, the retainer portion being adjustably connected to the holder shank such that the retainer wedge surface engages the shank wedge surface so as to expand the effective shank.

24. The excavation cutting tool holder retention system of claim 23 wherein the tool holder bore has a bore interior surface and the retainer portion has a retainer engagement surface, the retainer engagement surface and holder shank defining an effective shank dimension which is expandable within the tool holder bore so as to retain the effective shank within the tool holder bore.

25. The excavation cutting tool holder retention system of claim 24 wherein at least a portion of the retainer engagement surface is a retainer compressible surface such that the retainer compressible surface is compressed against the bore interior surface so as to retain the effective shank within the tool holder bore when the effective shank dimension is expanded.

26. The excavation cutting tool holder retention system of claim 25 wherein the tool holder bore has a bore recess and at least a portion of a compressible surface of the retainer engagement surface protrudes into the bore recess when the retainer compressible surface is compressed.

27. The excavation cutting tool holder retention system of claim 23 wherein the tool holder has a holder bore, the holder bore intersecting at least a portion of the holder shank, and the retainer portion has a retainer pin bore, at least one of the holder bore and retainer pin bore being threaded, and further including a pin having a pin threaded portion, the pin running through the holder bore and retainer pin bore and the pin threaded portion threadably engaging the at least one of the holder bore and retainer pin bore so as to adjustably connect the retainer portion and holder shank such that by rotation of the pin the retainer portion is movable relative to the holder shank.

28. An excavation cutting tool holder retention system comprising:

a support block having a tool holder bore, and a tool holder having a holder shank and a holder bore, the holder bore intersecting at least a portion of the holder shank;

a retainer;

a pin running through the holder bore and adjustably connecting the retainer to the holder shank such that the retainer is movable relative to the holder shank and such that the holder shank and retainer cooperate to retain the holder shank within the tool holder bore wherein the holder shank has a shank wedge surface and the retainer has a retainer wedge surface which slidingly engages the shank wedge surface such that the retainer is movable relative to the holder shank.

29. The excavation cutting tool holder retention system of claim 26 wherein the holder shank has a shank axis and the shank wedge surface is inclined relative to the shank axis.

30. The excavation cutting tool holder retention system of claim 29 wherein the shank wedge surface has a first shank wedge surface portion on one side of the holder bore and a second shank wedge surface portion on the other side of the holder bore.

31. The excavation cutting tool holder retention system of claim 28 wherein the retainer has a threaded retainer pin bore and the pin has a pin head which engages the holder bore and a pin threaded portion which threadably engages the threaded retainer pin bore such that the pin head may be rotated to draw the holder shank and retainer towards each other and such that the retainer wedge surface slidingly engages the shank wedge surface so as to move the retainer relative to the holder shank.

32. The excavation cutting tool holder retention system of claim 31 wherein the shank wedge surface has a first shank wedge surface portion on one side of the holder bore and a second shank wedge surface portion on the other side of the holder bore and the retainer wedge surface has a first retainer wedge surface portion located on one side of the retainer pin bore and a second retainer wedge surface located on the other side of the retainer pin bore such that the first and second retainer wedge surface portions slidingly engage the first and second shank wedge surface portions respectively.

33. The excavation cutting tool holder retention system of claim 31 wherein the pin has a pin diameter and the holder pin bore has a holder pin bore diameter greater than the pin diameter to facilitate lateral movement of the retainer relative to the holder shank.

34. An excavation cutting tool holder retention system comprising:

a support block having a tool holder bore, the tool holder bore having a bore interior surface;

a tool holder having a holder shank; and a retainer having a retainer compressible surface, the retainer being adjustably connected to the tool holder such that the retainer compressible surface is compressed against the bore interior surface so as to retain the holder shank within the tool holder bore;

wherein the tool holder bore has a bore recess and at least a portion of the compressible surface of the retainer protrudes into the bore recess when the retainer compressible surface is compressed.

35. An excavation cutting tool holder retention system comprising:

a support block having a tool holder bore, the tool holder bore having a bore interior surface;

a tool holder having a holder shank; and a retainer having a retainer compressible surface, the retainer being adjustably connected to the tool holder such that the retainer compressible surface is compressed against the bore interior surface so as to retain the holder shank within the tool holder bore;

wherein the holder shank and the retainer compressible surface define a shank effective dimension which is adjustably expandable within the too holder bore and such that the retainer compressible surface is compressed against the bore interior surface so as to retain the holder shank within the tool holder bore.

36. The excavation cutting tool holder retention system of claim 35 wherein the tool holder bore has a bore recess and at least a portion of the compressible surface of the retainer protrudes into the bore recess when the retainer compressible surface is compressed.

* * * * *